US005560436A

United States Patent [19]

Awad et al.

[11] Patent Number: 5,560,436

[45] Date of Patent: Oct. 1, 1996

[54] SINGLE DRILLING GUIDE BASE FOR SUBSEA OIL WELLS

[75] Inventors: Samir P. Awad; Emmanuel F. Nogueira, both of Rio de Janeiro, Brazil

[73] Assignee: Petroleo Brasileiro S.A. - Petrobras, Rio de Janeiro, Brazil

[21] Appl. No.: 428,366

[22] Filed: Apr. 25, 1995

[30] Foreign Application Priority Data

Apr. 25, 1994 [BR] Brazil ..... 9401593

[51] Int. Cl.[6] ..... E21B 7/128

[52] U.S. Cl. ..... 175/7; 175/10; 166/349; 166/365

[58] Field of Search ..... 175/7, 10; 166/349, 166/365

[56] References Cited

U.S. PATENT DOCUMENTS

| | | | |
|---|---|---|---|
| 2,917,281 | 12/1959 | Kofahl | 175/7 |
| 3,032,125 | 5/1962 | Hiser et al. | 175/7 |
| 3,047,078 | 7/1962 | Postlewaite | 175/7 |
| 3,050,139 | 8/1962 | Hayes | 175/7 |
| 3,114,420 | 12/1963 | Wilde | 175/7 |
| 3,129,774 | 4/1964 | Armstrong | 175/7 |
| 3,191,696 | 6/1965 | Pollard et al. | 175/7 |
| 3,252,529 | 5/1966 | Fischer | 175/7 |
| 4,877,088 | 10/1989 | Rodrigues et al. | 166/342 |
| 4,960,174 | 10/1990 | Rodrigues et al. | 166/342 |

FOREIGN PATENT DOCUMENTS

| | | |
|---|---|---|
| 8700104 | 1/1988 | Brazil . |
| 8900855 | 10/1990 | Brazil . |

*Primary Examiner*—Roger J. Schoeppel
*Attorney, Agent, or Firm*—Sughrue, Mion, Zinn, Macpeak & Seas

[57] ABSTRACT

A single drilling guide base for subsea oil wells includes two parts, namely a lower part (1) and an upper part (2), which are bolted together (at 7). The whole arrangement is provided with a seating indicator (5) connected to the lower part and holes in a funnel shaped portion of the upper part for the discharge of gravel.

3 Claims, 3 Drawing Sheets

SINGLE DRILLING GUIDE BASE FOR SUBSEA OIL WELLS

BACKGROUND OF THE INVENTION

The invention relates to a piece of equipment to be installed on the sea bed for subsea oil well drilling. More specifically, the object of invention is to provide a single structure to be installed on the sea bed, intended to serve as a base for subsea oil well drilling work.

The discovery of oil fields lying within continental shelves has led to the development of new techniques in the drilling of oil wells. Throughout the years new equipment and methods of work have been developed by the specialists for the purpose of facilitating the difficult task of drilling for subsea oil.

Starting from simple adaptations of equipment used for onshore work, subsea drilling techniques have developed to the point of having to call into play highly complex equipment, very different from that employed onshore, and requiring the efforts of specialists endowed with a high degree of technical knowledge.

Among the various kinds of equipment developed for enabling subsea oil drilling to take place, those known as drilling guide bases are a typical example of the progress that has been made in subsea drilling techniques. A drilling guide base is fastened to the first casing of a well driven in the sea bed and serves several purposes including the guiding of other nearby well casings to ensure a vertical well. The consequences can be serious if a drilling guide base fails to ensure that the various casings are properly vertical.

The first guide bases developed to meet the requirements of oil subsea drilling work comprised largely two structures.

The first was referred to by the specialists as a temporary guide base and was laid on the sea bed coupled to the well pipe casing. Though it is provided with devices for offseting tilting, its natural tendency is to match unevenness in the sea bed, which is of course not desirable because in doing so it will make vertical well drilling difficult.

As a way of overcoming this drawback a second structure, referred to by the specialists as a permanent guide base, was laid over the temporary one. This second guide base had devices intended to offset any tilting of the temporary guide base.

Brazilian application PI 8700104-7 shows a typical example of a guide base made up of temporary and permanent bases, where the permanent guide base rests on the temporary guide base by means of a semi-spherical surface correcting any tilting that may have taken place when the temporary guide base was laid.

Brazilian application PI 8900855-3 introduced an inovation by proposing that a single guide base be employed to guide subsea drilling operations, and enabling vertical wells to be drilled regardless of the unevenness of the sea bed.

This single guide base comprises a cylindrical structure which has in its upper, part a funnel to guide the descent of the pieces of equipment into the well. To give strength to the assembly and to enable it to be put in a vertical position, a driven pile is jetted into the sea bottom, all of this operation being monitored by television in a remote operated vehicle; the slope of the assembly being controled with the aid of a level indicator.

The next step is to install the low-pressure housing with its casing. This low-pressure housing is placed upon another housing previously bolted to,the base. Then the casing is cemented.

Next the well is drilled, after which the head pressure housing and its respective casing set and finally cementing is carried out, all of which provides a firm base to support the other casings to be installed in the well.

This single guide base has brought about great progress in well drilling techniques and has led to considerable savings because it has done away with certain parts and expensive operations. However, there are still some shortcomings, of which the principal one concerns the large size of the arrangement which makes hauling and installing very difficult.

SUMMARY OF THE INVENTION

The present invention makes significant alterations to the single guide base in subsea drilling for oil, making it lighter and more efficient as well as creating devices that enable better monitoring of the laying operations.

The invention relates to a single guide base used in the drilling of oil wells, whereby the low pressure housing is mounted directly to the guide base thus doing away with the need for another housing to ensure sturdiness of the arrangement.

Accordingly, the present invention provides a single subsea oil well drilling guide base comprising a lower part bolted to an upper part whose top surface is funnel-shaped for helping to guide down equipment and tools used in the well drilling stage; wherein said guide base is provided with bolts to hold a housing and with holes to enable gravel drilled out to issue from inside the base before the well casing is installed.

The lower part may be provided with a device to show how the arrangement is being seated, which enables a better view of the operation in a remote operated vehicle by means of a television circuit.

BRIEF DESCRIPTION OF THE DRAWINGS

In order that the present invention may more readily be understood the following description is given, merely by way of example, with reference to the acompanying drawings, in which.

DETAILED DESCRIPTION OF THE INVENTION

Figure 1:
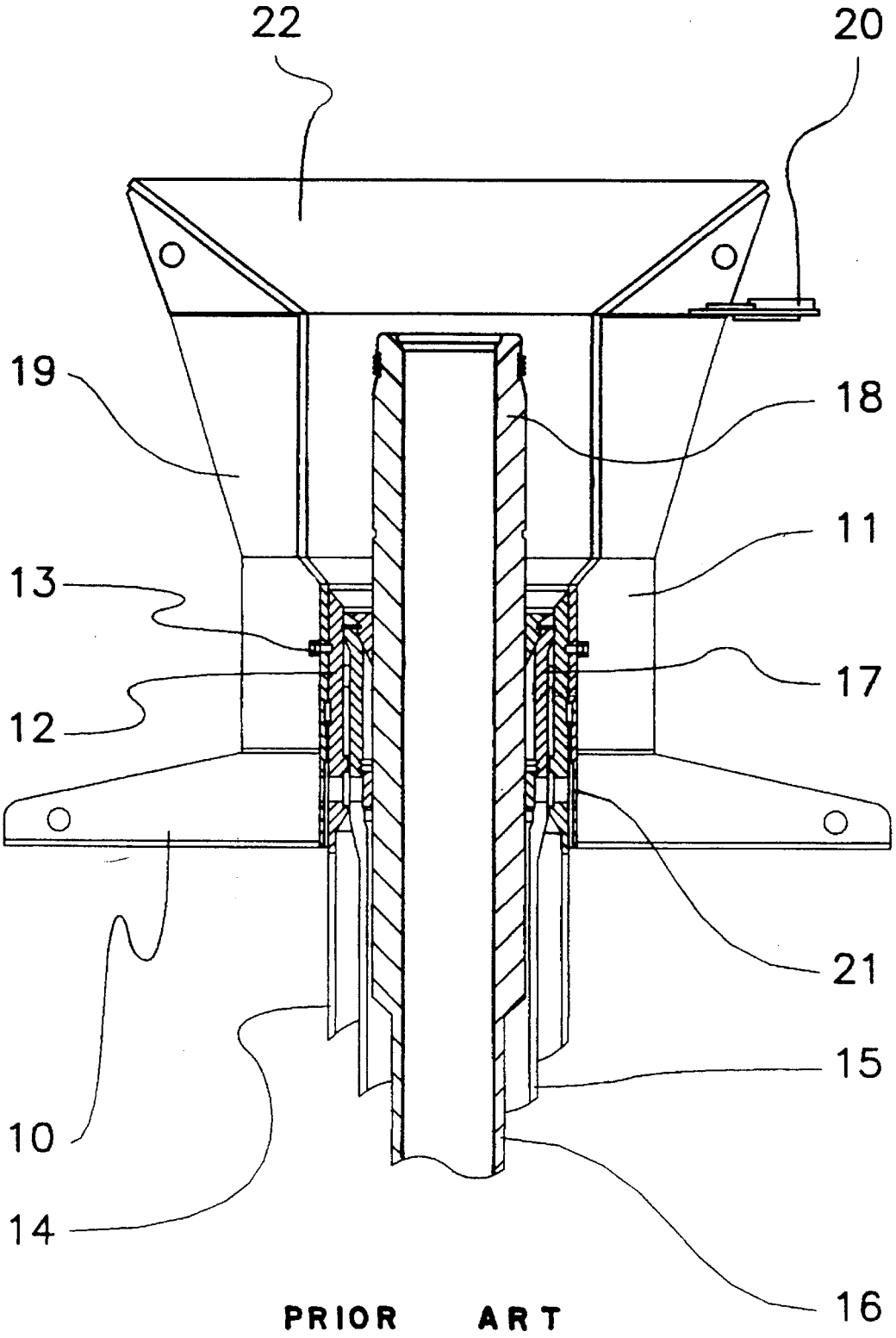
FIG. 1 is a front view of a section of the prior art subsea oil well drilling guide base.

Before starting to describe the invention, reference will first be made to FIG. 1 in which can be seen a prior art subsea oil well drilling guide base.

This drilling guide base comprises a lower part 10, which acts as a support, an intermediate cylindrical part 11 coupled with the lower part 10, an lower cylindrical part 19 which is coupled with said intermediate cylindrical part 11, and a funnel-shaped upper part 22, superposed on said upper cylindrical part 19 and intended to guide tools down into the well.

A housing 12 is bolted to the intermediate cylindrical part 11 by means of bolts 13; a pipe 14, referred to by the experts as a conductor is connected to said intermediate cylindrical part 11. A second intermediate housing 17 is mounted on the housing 12, with its respective pipe 15 which is also known as a conductor. Finally a high pressure housing 18, with its respective pipe 16, is mounted on the intermediate housing 17.

The guide base is fitted with a level 20 which enables the verticality of the assembly to be checked by means of a television circuit of a remote operated vehicle. Holes 21 are provided in the lower part for the discharge of gravel.

The guide base described above was a big step forward in the subsea oil well drilling techniques but it still suffers from some shortcomings. The use of two housings with their respective conductors means that its size and weight are considerable, which makes it rather awkward to ship, whether from the point of construction to the quay side fop shipping, or whether from the instant of off-loading on to a supporting vessel up to the time of delivery to a drilling rig that is to install it.

Another point to be borne in mind is the increase in cost due to the use of two housings and their respective conductors, not to mention the extra cost incurred through longer use of a drilling rig to lay the two housings. All these costs add up to a great amount.

Figure 2:
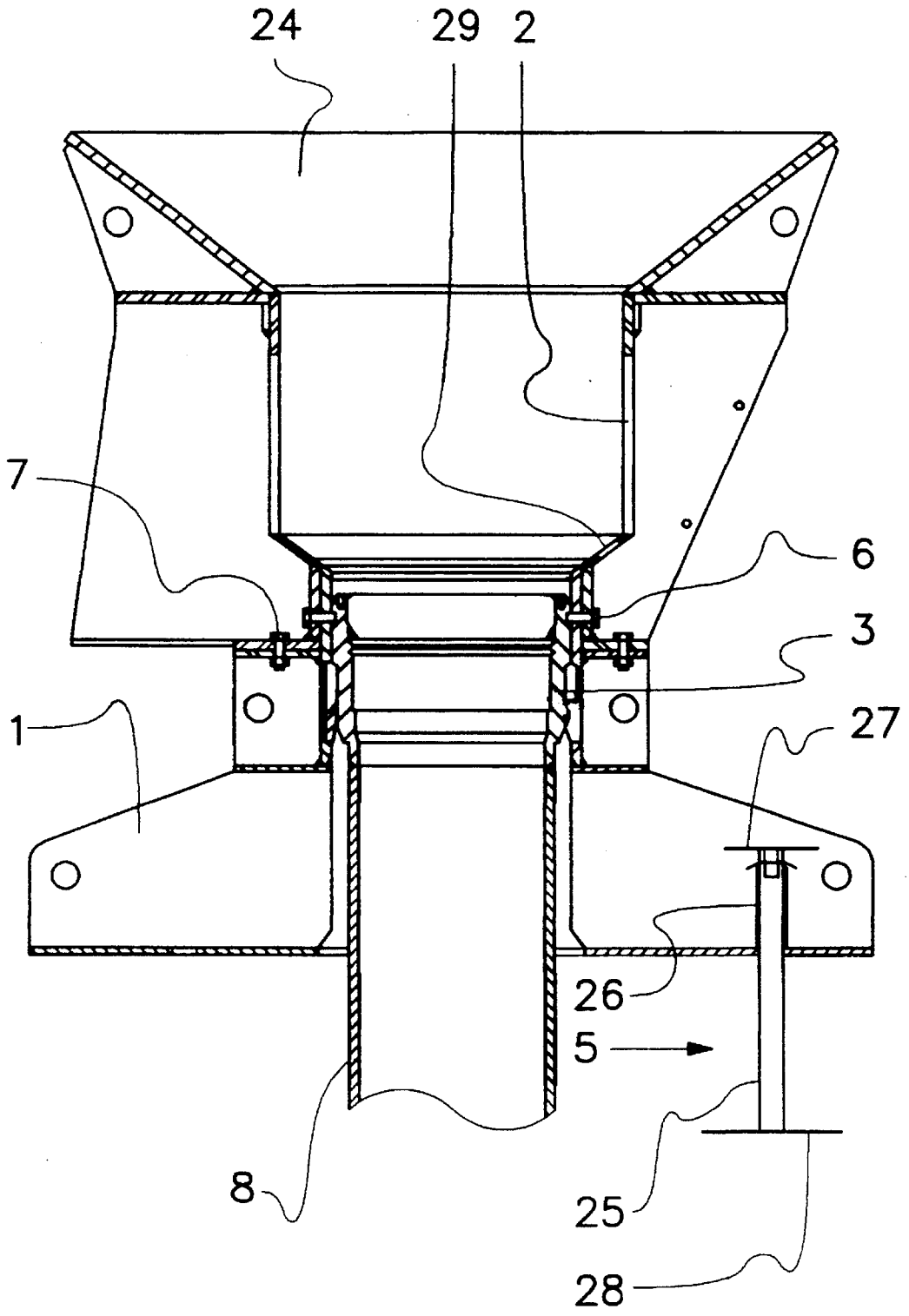
FIG. 2 is a front view of a subsea oil well drilling guide base in accordance with this invention, before being laid on the bottom of the sea.
Figure 3:
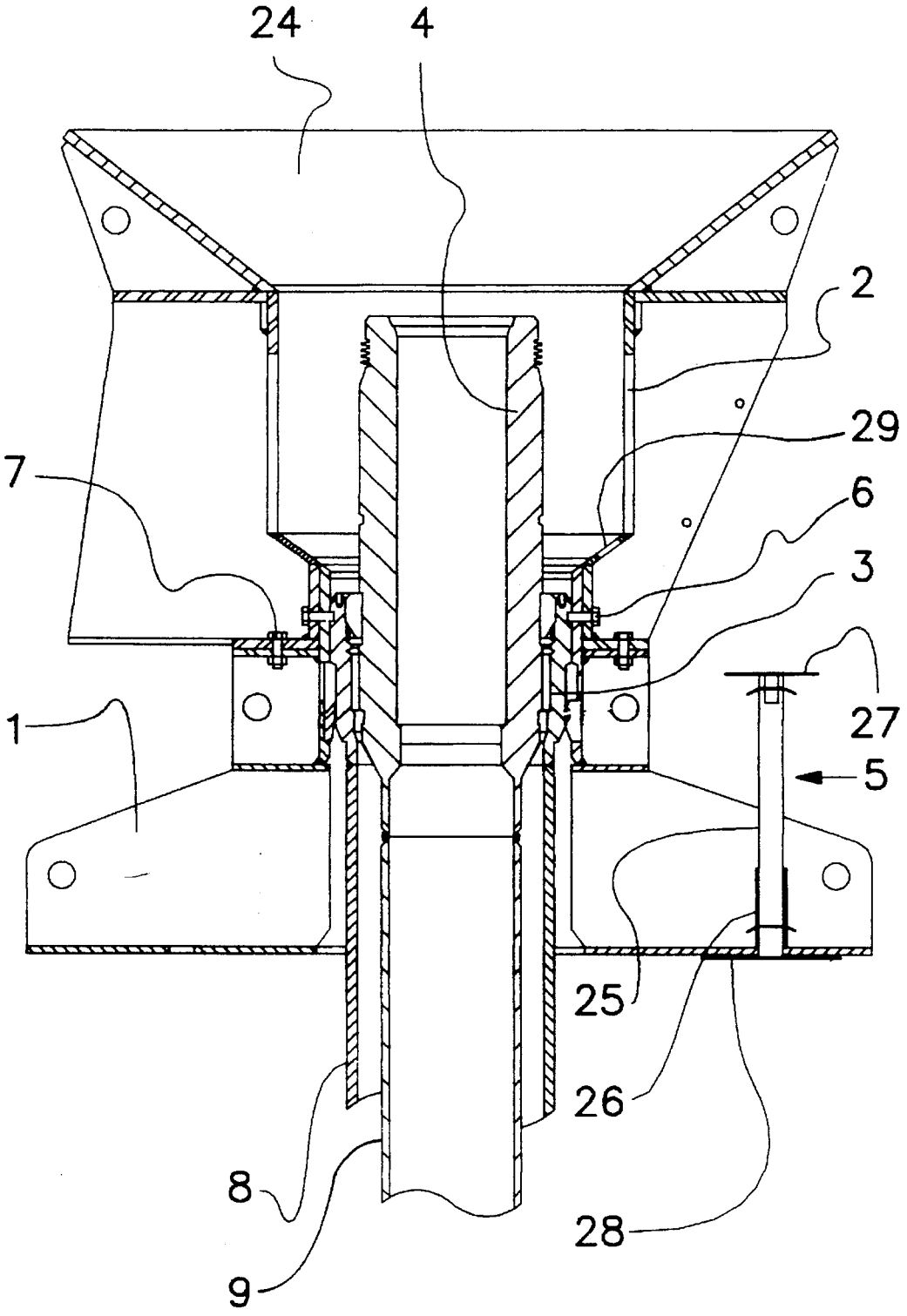
FIG. 3 is a front view section of the subsea oil well drilling guide base after being laid on the sea bed.

FIGS. 2 and 3 show an embodiment of a single guide base according to the present invention.

The two parts, the lower part 1 and the upper part 2, are bolted together by bolts 7 thereby making up the body of the guide base. This is rather an important feature of the guide base for it enables the lower part 1 and the upper part 2 to be easily carried separately to whatever place is most suitable for them to be bolted together, thereby considerably lowering the cost of shipping and also the time needed for the job.

A housing 3 with its casing pipe 8 is mounted on the guide base body, said housing 3 being bolted to the guide base by means of bolts 6 as shown in FIGS. 2 and 3. The assembly is then fixed to the sea bottom, preferably by jetting, in such a way that casing 8 sinks gradually in until the lower part of body of guide base is resting on the sea bed.

In order to ensure that the gravel arising out of the drilling process does not heap up and hinder the observation and monitoring of the operation, there are holes 29 in the upper part 2, intended to let gravel out of the lower part of the guide base, thus preventing it from gathering there.

FIGS. 2 and 3 show a seating indicator rod 5, coupled together with the lower part 1, this being just a longitudinal part 25 of any cross-sectional shape, fitted into a small segment of a tubular guide 26, which is smaller than said longitudinal part 25. The longitudinal part 25 is provided at its top and bottom with stops 27 and 28, which are bigger than the outer diameter of the tubular guide 26 so that the longitudinal part 25 may travel freely within tubular guide 26 without escaping, since prevented by stops and 28.

FIG. 2 shows the indicator rod 5, in the position it occupies before it touches the sea bottom, and FIG. 3 shows its position after guide base has been laid place.

The purpose of the indicator rod 5 to enable the operator to be sure that job has been done properly. The operator watches over all the laying of the guide base by means of a television circuit in a remote operated vehicle. Just watching, without the use of an indicating rod 5, will not be enough to ensure that the guide base is actually contact with the sea bed since gravel which usually gathers around the place where the guide base is being installed could possibly mislead the operator into believing that the guide base is resting on the sea bed when really it is only lying on top of such heaped-up gravel.

In such cases, that is, where the operator finishes sinking the casing into the sea bed having been convinceded that guide base is properly seated, the consequences can turn out to be disastrous, for the soundness of the whole arrangement will be threatened, and the stability of all equipment to be installed over the guide base will be prejudiced.

By using the indicator rod 5, it becomes a lot easier for the operator to know when the job really is finished, for all he has to do is to watch the indicator rod 5 to have reliable information about the job. As soon as the longitudinal part 25 touches the sea bed it becomes pushed upwards, sliding freely within the tubular guide 26, as can easily be seen by the operator watching it rise.

Once the single guide base for drilling into the sea bed has been properly laid, actual drilling of the well can begin. FIG. 3 shows the while well head assembly already in place, with its high pressure housing 4 mounted on housing 3, and the casing 9 also connected to the aforesaid wellhead high pressure housing 4.

All this serves to show that the subsea oil well drilling guide base of the present invention is very useful, for it is cheaper to make, easier and less expensive to ship, and much simpler to install, thereby helping to cut down even more the final cost of subsea oil well drilling work.

What is claimed is:

1. A single subsea oil well drilling guide base comprising a lower part (1) bolted to an upper part (2), whose top surface (24) is funnel-shaped for helping to guide down equipment and tools used in the well drilling stage;

wherein said guide base is provided with bolts (6) to hold a housing (3) and with holes (29) in a funnel-shaped portion of said upper part to enable gravel drilled out to issue from inside the base before the well casing (B) is installed.

2. A guide base according to claim 1, wherein said lower part (1) is provided with a seating indicator rod (5) which comprises a longitudinal part (25) of any kind of cross-sectional shape and able to travel freely within a tubular guide (26) whose length is less than that of said longitudinal part (25); and wherein said longitudinal part (25) is provided with axially spaced stops (27, 28) to prevent said longitudinal part (25) from leaving said tubular guide (26).

3. A guide base according to claim 2, wherein said stops (27,28) are at the top and bottom ends of said longitudinal part (25).

* * * * *